United States Patent [19]

Maya

[11] Patent Number: 4,958,652

[45] **Date of Patent: * Sep. 25, 1990**

[54] PORTABLE SUN SHADE

[76] Inventor: Rachel Maya, 441 N. Curson Ave., Los Angeles, Calif. 90036

[ * ] Notice: The portion of the term of this patent subsequent to Apr. 25, 2006 has been disclaimed.

[21] Appl. No.: 329,540

[22] Filed: Mar. 28, 1989

Related U.S. Application Data

[63] Continuation-in-part of Ser. No. 159,811, Feb. 24, 1988, Pat. No. 4,823,822.

[51] Int. Cl.[5] ..... E04H 15/00

[52] U.S. Cl. ..... 135/87; 135/900

[58] Field of Search ..... 135/113, 117, 900, 902, 135/87; 52/70, 71, 79.1; 160/351, 352, 370.2; 248/152, 174; 446/80, 82, 478, 488; 229/16 A, 41 R

[56] References Cited

U.S. PATENT DOCUMENTS 1,215,962 2/1917 Morrison et al. ..... 446/82

3,139,255 6/1964 Palm ..... 248/152 X 3,346,317 10/1967 Peggs ..... 248/174 X 4,657,520 4/1987 Sheffer ..... 446/488

4,759,520 7/1988 Levine ..... 160/229.1

FOREIGN PATENT DOCUMENTS 155044 12/1920 United Kingdom ..... 248/174

*Primary Examiner*—Richard E. Chilcot, Jr.

*Assistant Examiner*—Lan Mai

*Attorney, Agent, or Firm*—David O'Reilly

[57] ABSTRACT

A portable shelter which can be quickly and easily set up at the beach or other recreation area. The shelter is formed of a sheet of lightweight material having creases to form hinges between back and roof panels and supporting side panels. The side panels having upper and lower sections which have mutually engaging slots. The shelter is easily and quickly set up by folding the lower side panel sections approximately ninety degrees to the back and interlocking the mutually engaging slots of the upper and lower side panel sections.

6 Claims, 2 Drawing Sheets

PORTABLE SUN SHADE

This application is a continuation of application Ser. No. 07/159,811, filed Feb. 24, 1988 now U.S. Pat. No. 4,823,822 4/25/89.

FIELD OF THE INVENTION

This invention relates to portable shelters such as sun shades, umbrellas, canopies and the like and more particularly relates to an inexpensively constructed portable shelter which can be quickly set up almost anywhere.

BACKGROUND OF THE INVENTION

Portable shelters such as Umbrellas, canopies and various sun shades devices are becoming increasingly popular. The apparent reason for this popularity is that people are becoming more and more conscious of the detrimental effects of the sunshine particularly the increasing occurrence of skin cancer.

Additionally, portable shelters such as umbrellas, canopies and the like have always been a popular item on the beach and other recreational areas. They are frequently rented or purchased to use for protection against sunshine as well as the wind. However, the disadvantage of these devices is the expense of renting them as well as the expense of purchasing or repairing these items. Beach umbrellas can be quite expensive, as can full size canopies to provide a shaded area.

It is therefore one object of the present invention to provide a inexpensive, easily assembled, portable shelter.

Yet another object of the present invention is to provide a portable shelter which can be easily set up and is inexpensive enough that it can be easily replaced.

Yet another object of the prevent invention is to provide a portable shelter which is easily assembled which is also extremely light weight and easy to transport.

BRIEF DESCRIPTION OF THE INVENTION

The purpose of the present invention is to provide a transportable shelter which is light in weight, inexpensive to construct and easily assembled and set up.

The purposes of the invention are achieved by providing a shelter having a plurality of panels made from a corregated material, having folds which allow the device to be easily set up to provide shade. When set up the shelter provides back and side panels which include lower portions for embedding in the sand or soft turf, with upper portions bending forward and over the head to provide an awning-like shade. Additionally, upper side panel extensions have slots which mate with similar slots in the lower side panel extensions to hold the shade in an assembled or set up position providing cover from wind and sun. An additional small extending panel on the upper, or roof portion of the shelter, provides a visor providing additional sun protection. A number of strategically placed partial cut-outs in the panels can be opened to provide circulation of air under the shade.

The portable shelter is preferably made from corregated cardboard preformed and scored at areas to easily bend for assembly. A unique advantage of this system is that when completely folded it results in a rectangular construction having handle cut-outs and can be easily carried. An additional unique feature of the invention is that when the shelter is folded flat the exposed panels, particularly the back panel, are excellent for use as advertising or promotional mediums.

The above and other novel features of this invention will be fully understood from the following detailed description and the accompanying drawings, in which:

DETAILED DESCRIPTION OF THE INVENTION

Figure 1:
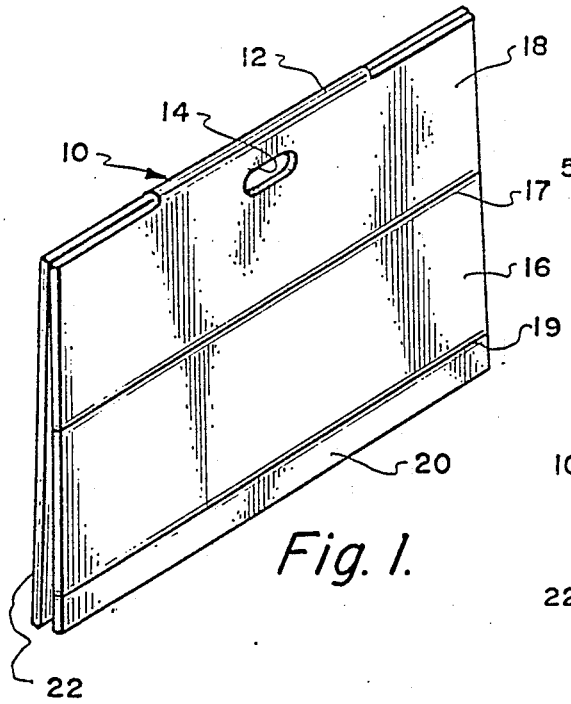
FIG. 1 is a perspective view of the portable shelter according to the invention, folded flat for transport.

A portable easily set up shade is illustrated generally in FIG. 1 in a flat folded transportable configuration. The shade 10 is preferably of an inexpensive material, such as corregated cardboard, configured to easily fold into the flat position to provide a carry handle or slot 14. Preferably the width of the device when folded flat is small enough to be easily carried under the arm.

The compact folded shelter 10 is a double folded single homogeneous sheet creased to form a main fold line 12 having handle 14 formed by slots, as will be described in greater detail hereinafter. The facing side of the shelter shown in FIG. 1 has roof top panel 16, roof back panel 18 and visor 20 on one side, with the back panel 22 behind. When all sides and panel extensions are folded inside, as shown in FIG. 1, the shelter can be easily carried about by handle 14.

Figure 2:
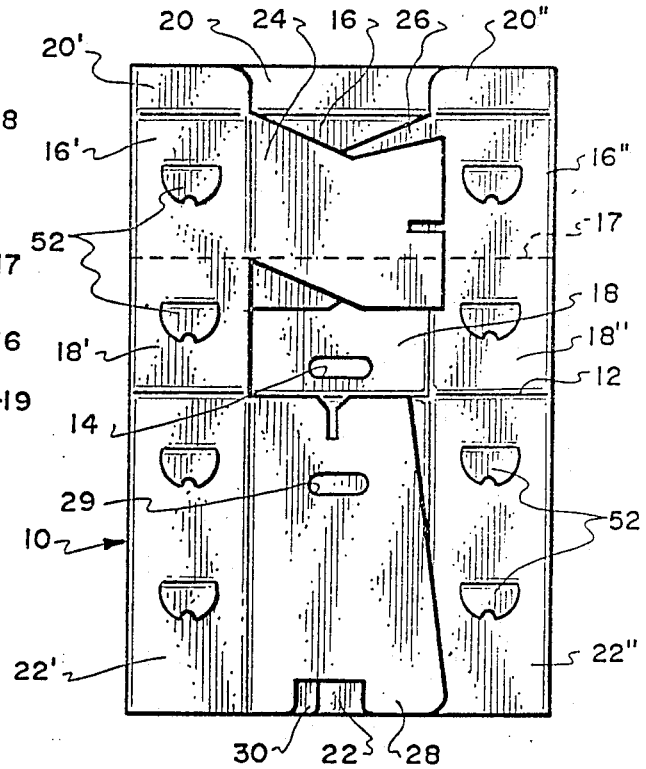
FIG. 2 is a view of the shelter of FIG. 1 with flat sides opened prior to assembly.

The shelter 10 is shown in a partially opened position in FIG. 2 having upper side panels 24 and 26 folded inwardly flat against the inside surface of roof top panel 16 and roof back panel 18. Panels 16'16'', 18', 18'', 20' and 20'' are left and right extensions respectively of the roof top 16, roof back 18, and visor 20 panels respectively. Lower side panels 28 and 30 also fold inward against the interior surface of back panel 22. Panels 22' and 22'' are left and right extensions of back panel 22 respectively.

The shelter is shown completely unfolded in FIG. 8 ready to be set up. The left and right sides unfold at creases forming fold lines 32 and 34, with upper side panels 24 and 26 and lower side panels 28 and 30 ready for interlocking assembly into an upright shelter.

Figure 4:
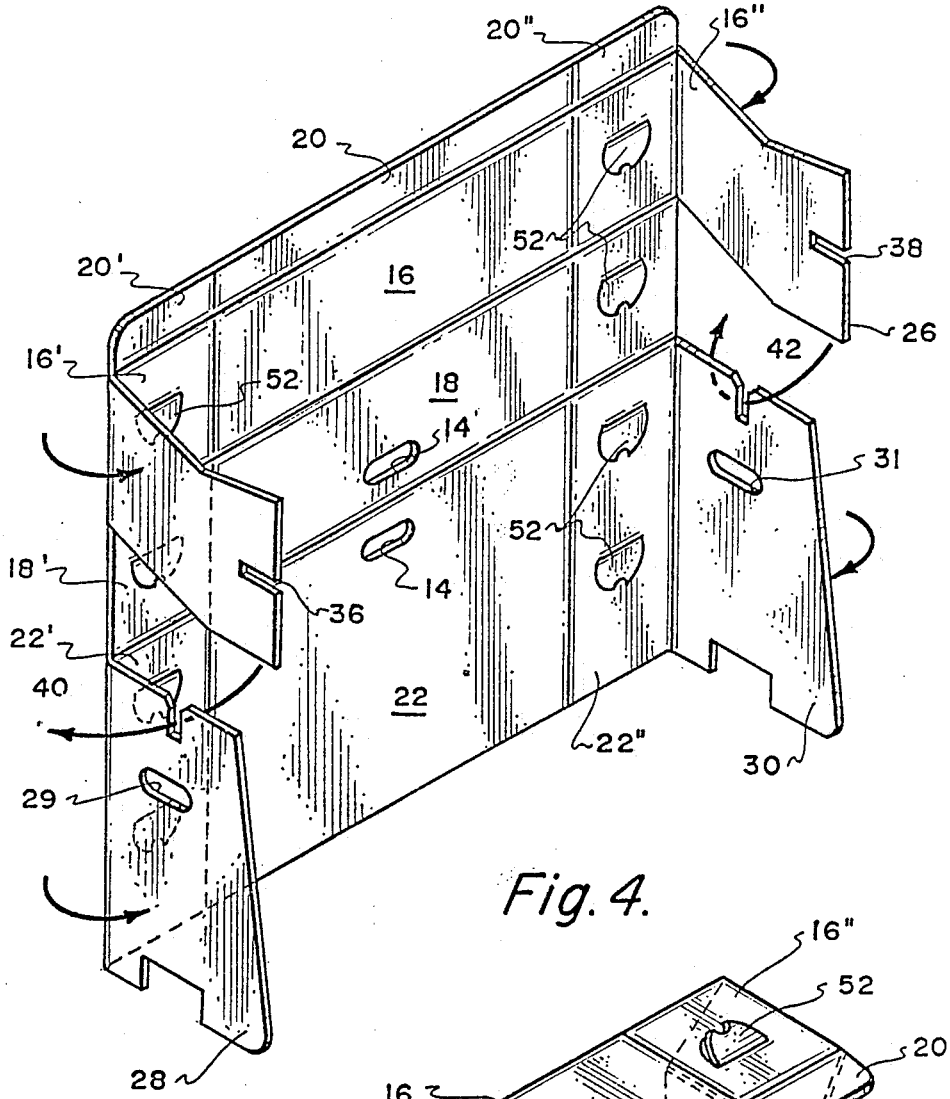
FIG. 4 is a perspective view illustrating the initial steps in assembling the portable shelter.

FIGS. 4 and 6 illustrate the ease with which the shelter can be set up and taken down. Lower left and right panels 28 and 30 are folded inward at ninety degree angles to back panel 22 and back panel extensions 22' and 22''. This holds the shelter in an upright position for inserting slots 86 and 38 of upper side panels into slots 40 and 42 of the lower side panels.

Figure 3:
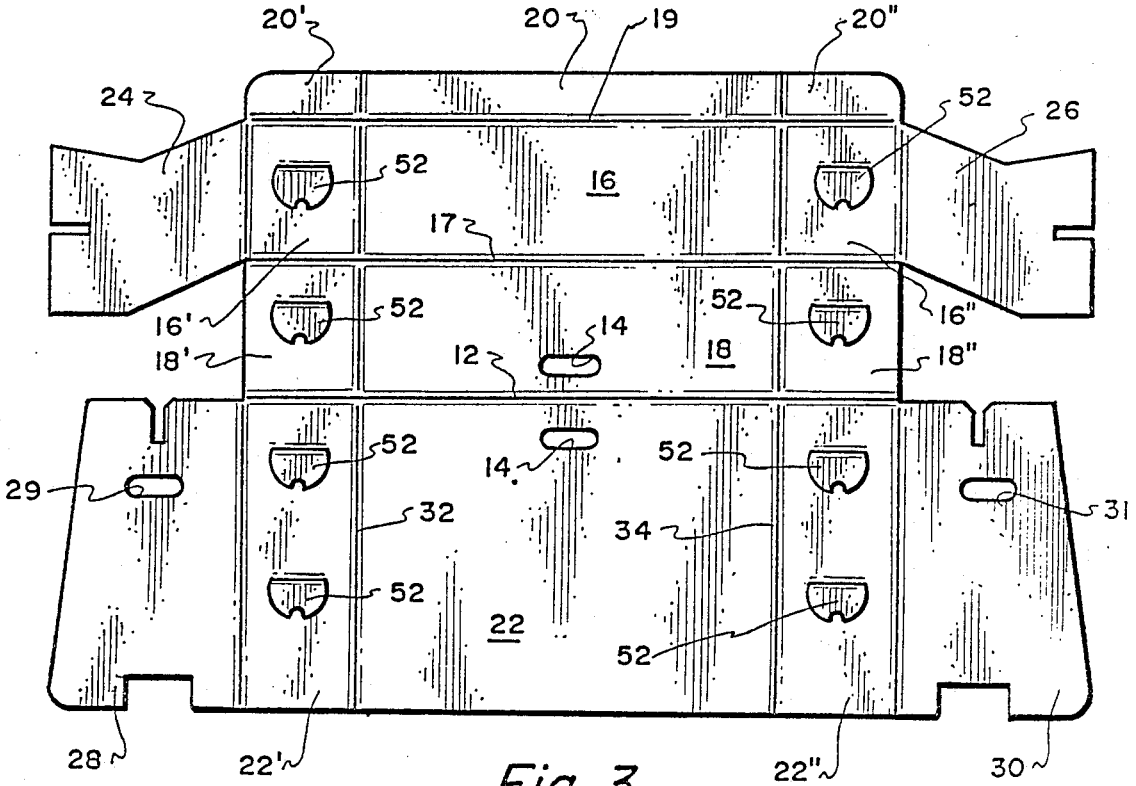
FIG. 3 is a front elevation of the portable shelter with all surfaces completely opened flat, in preparation for assembly.

The one piece homogeneous construction can be visualized from the flat unfolded position illustrated in FIG. 3 as having six sectors which when folded together as shown in FIG. 1 form an easily transported simple to set up shelter. The six sectors are back panel 22 and roof panels comprised of roof top 16, roof slant back 18 and visor 20; upper left and right sectors comprised of left and right side panels 24,26 and roof top extensions 16',16", roof slant back extensions 18',18" and visor extensions 20',20"; and lower right and left sectors comprised of lower side extensions 28,30, and back extensions 22' and 22".

Figure 5:
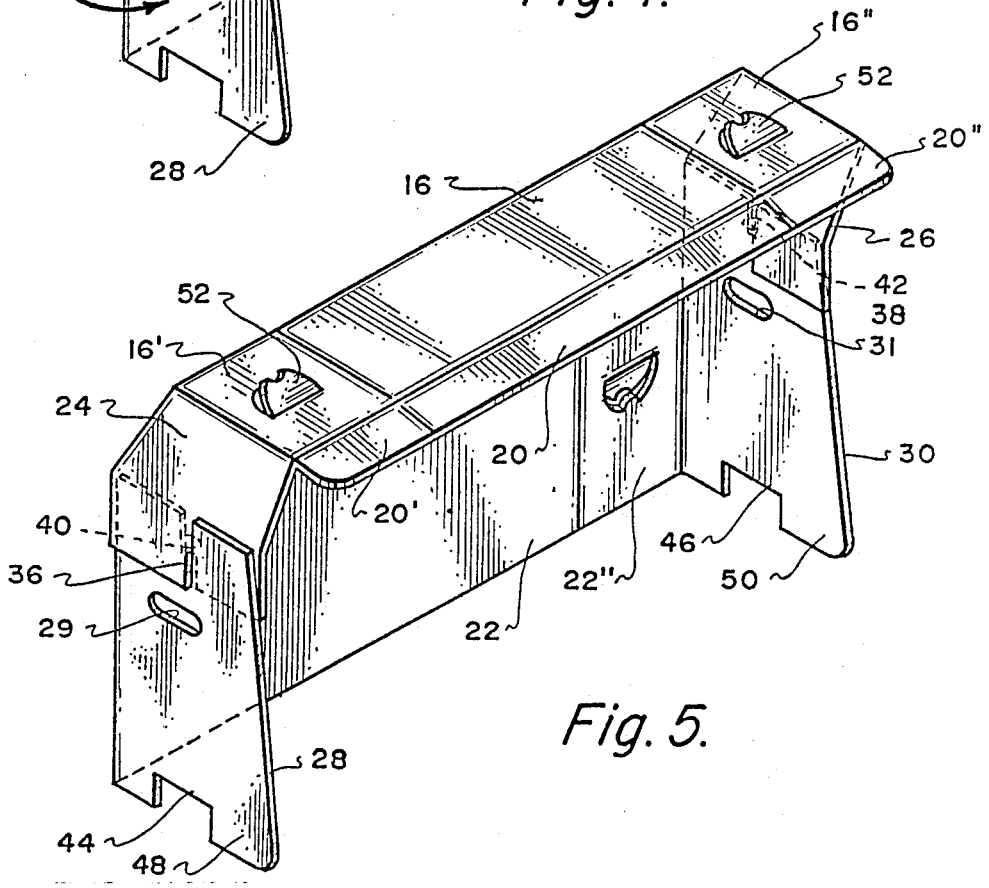
FIG. 5 illustrates the shelter fully assembled and positioned for use to provide shade or protection against the wind.

After unfolding the portable canopy or shelter, as shown in FIG. 3, only two simple steps are required to set it up. Lower side panels 28 and 80 are folded inward at a ninety degree angle as shown if FIG. 4, and slots 36 and 38 are insert in slots 40 and 42 in lower side panels 28 and 30 completing the set up shelter, as shown in FIG. 5. Slots 44 and 46 in lower side panels 28 and 30 produce flanges or feet 48 and 50 which can be embedded in sand or soft soil to steady the shelter on a beach-,park or the like area. Handle cut-outs 29 and 31 in lower left and right side panels 28 and 30 can be used to apply a downward pressure forcing flanges 48 and 50 into the sand or soft turf to anchor the shelter. Crescent shaped cuts in the material forming the shelter provide vents 52 that can be opened outward or inward to allow circulation of air around the shelter.

To fold the shelter for transportation the upper side panels 24 and 26 are lifted to disengage the interlocking slots 36, 38, 40 and 42 which causes the shelter to unfold and collapse to the flat position illustrated in FIG. 3. The upper left and right sectors are then folded in against the roof panels and the lower left and right sectors folded in against the back shown in FIG. 2 at creases forming folding integral hinges 32 and 34 ((FIG. 3).

Finally, the roof sections and back sections are folded together at the crease forming main folding integral hinge 12, shown in FIG. 1. Handle cut-outs 14 in roof back 18 and back 22 provide an easy carry handle for the portable shelter. Handle cut-outs 29 and 30 in lower left and right side panels 28 and 80 are useful to exert downward pressure to anchor the shelter in sand or soft turf, as previously described.

It is also preferred that the overall width of the shelter from the fold line or hinge 12 to the outer edge of visor 20 be such that the portable shelter can also be easily carried under the arm if desired. This shelter can be thus carried comfortably to a beach or recreation area and quickly set up by unfolding as shown in FIGS. 2, 3 and 4, interlocking the slots in the adjacent side panels resulting in a completely assembled inexpensive light weight shelter, as shown in FIG. 5. While corregated cardboard is the preferred material of construction any lightweight material that can be formed into the homogeneous construction disclosed would be suitable.

This invention is not to be limited by the embodiment shown in the drawings and described in the description which is given by way of example and not of limitation, but only in accordance with the scope of the appended claims.

What is claimed is:

1. A portable apparatus for use as shelter for protection against sunshine and wind comprising:

a homogeneous sheet of lightweight material having creases forming hinges connecting a roof panel, a back panel and side panel means; said side panel means when folded at approximately right angles to said back panel holding said homogeneous sheet in a upright position, means for securing said side panel means at said approximately right angles to said back panel; said means for securing said side panel means at said approximately right angels to said back panel comprising interlocking means for interlocking said side panel means with said roof panel to hold said side panel means substantially at right angles to said roof panel; said roof panel and back panel being approximately equal in area; said side panels constructed to fold flat against said roof panel and said back panel respectively so that said roof panel and back panel can be folded inward against each other with said side panels inside; whereby said homogeneous sheet of lightweight material may be held upright to form a shelter by interlocking side panel means with said roof panel and folded into a flat rectangular shape which can be easily carried when not in use.

2. The apparatus according to claim 1 including an extension of said roof panel forming a visor.

3. The apparatus according to claim 1 including a plurality of crescent shaped cuts through said material forming flaps which can be opened inward or outward to provide vents.

4. The apparatus according to claim 1 in which said homogeneous sheet is creased to form six sectors comprised of upper left and right sectors and lower left and right sectors which fold inwardly against said roof panel and back panel respectively; and a crease forming a folding hinge line between said roof panels and said back panel whereby said roof and back panels can be folded together with said upper and lower left and right sectors inside for easy transportability.

5. The apparatus according to claim 4 including slots in said roof panel, said back panels which are in alignment when said shelter is in a folded position thereby forming a carrying handle.

6. The portable shelter according to claim 1 in which side panel means comprises; upper and lower sections; said upper section being formed as an extension of said roof panel; said lower sections being formed as an extension of said back panel; said interlocking means comprising mutually engaging slots in said upper and lower sections of said side panel means holding said side panel sections at mutual right angles to said back panel.

* * * * *